United States Patent [19]

Zylbert et al.

[11] Patent Number: 4,519,330

[45] Date of Patent: May 28, 1985

[54] SEWING NEEDLE WITH TWO PORTION SHANK

[75] Inventors: Thaddeus J. Zylbert, Morris Plains, N.J.; Wolf-Dieter Fuhrmann, Aachen, Fed. Rep. of Germany; Hans Hammer; Fritz Kappertz, both of Wurselen, Fed. Rep. of Germany

[73] Assignee: The Singer Company, Stamford, Conn.

[21] Appl. No.: 566,249

[22] Filed: Dec. 28, 1983

[51] Int. Cl.[3] ..... D05B 55/02; D05B 85/00

[52] U.S. Cl. ..... 112/222; 112/226

[58] Field of Search ..... 112/222, 226; 273/102

[56] References Cited

U.S. PATENT DOCUMENTS 148,339 3/1874 Wardwell, Jr. .
188,648 3/1877 Loeske .
204,294 5/1878 Cook et al. .
659,999 10/1900 Blanchard .
1,323,340 12/1919 Weis ..... 112/222
3,469,548 9/1969 Zocher ..... 112/222
4,194,457 3/1980 Parsons .

FOREIGN PATENT DOCUMENTS 954123 12/1956 Fed. Rep. of Germany ..... 112/222

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

A needle for use in a sewing machine having a one-way needle clamp, in which the needle is formed with a shank having a minor portion adjacent the free extremity which cooperates with the one-way needle clamp to properly orient the sewing needle, and a major portion extending between the minor portion and the blade which includes a reference surface for locating the blade with respect to the sewing machine looptaker.

5 Claims, 14 Drawing Figures

SEWING NEEDLE WITH TWO PORTION SHANK

DESCRIPTION

Background of the Invention

This invention is concerned with sewing machine needles; more particularly, it is concerned with an improvement to a flow pressed needle to aid its one way insertion into a needle bar having the capability for accepting the sewing needle only in the proper orientation.

In the prior art, there are many examples of needle bars carrying needle clamps having the capability for preventing improper needle orientation. By way of explanation, sewing needles are fashioned with a long groove on one side of the blade thereof in which the thread extending to the eyelet at the tip of the sewing needle may lie. On the other side of the blade of the sewing needle, a short groove is accommodated adjacent the eye so that the thread on this side extending from the thread eyelet frictionally engages the work material through which it extends, so that, on elevation of the sewing needle through the work material, a loop of thread is caused to form behind the sewing needle which may be picked up by a loop taker in the process of stitch formation. Thus, the proper orientation for a sewing needle is with the short groove on the blade located adjacent the path of the loop taker beak.

In earlier sewing needles, this orientation was assured by grinding of a flat on the shank of a sewing needle which was then inserted in a needle clamp of a type above referred to. The flat on the shank of the sewing needle cooperated with the needle clamp to insure (1) the proper orientation of the short groove of the needle blade with the loop taker and (2) a proper spacing of the needle blade from the loop taker to insure loop seizure by the loop taker beak. A more advanced method for manufacturing sewing machine needles is referred to in the U.S. Pat. No. 4,128,067 issued on Dec. 5, 1978 to Zocher. In that patent, the flat on the shank of the sewing needle is not ground, but is instead die or flow pressed. However, flow or die pressing of sewing needles does not provide the definition heretofore obtained with grinding, and it frequently occurs that the cross section of the shank of a flow or die pressed needle may not differ substantially from a perfectly circular cross section. The result is that it is not always possible to obtain the proper orientation of the sewing needle with the needle clamp mentioned above.

What is required is some method compatible with die or flow pressing operations to insure one-way needle insertion into a needle clamp to obtain the proper orientation of the needle. It is, of course, desirable that this capability in the sewing needle be obtained in as economical a fashion as possible.

SUMMARY OF THE INVENTION

The above requirements are found in a needle for use in a sewing machine having a one-way needle clamp of the type having a needle shank or butt accommodating recess with a mouth shaped to admit a given irregular shaped needle shank in only one orientation, and a locating surface within the recess for locating a reference surface on the needle shank on a predetermined plane with respect to the sewing machine, the needle having a blade extending parallel to the lengthwise axis of the needle, and an enlarged shank including a minor portion adjacent the free extermity thereof with the minor portion being formed with the given irregular shape for cooperation with the needle clamp mouth to admit the needle into the needle clamp recess in only one orientation and with the enlarged shank having a major portion extending from the blade and formed with a reference surface for cooperation with the locating surface in the needle clamp. Thus, the shank of the sewing needle is formed with a shape over a small portion of the free extremity thereof which will go into the one-way needle clamp in only the proper orientation, with the remainder of the shank providing a surface in a predetermined plane with respect to the eye of the needle so that the eye will be properly spaced from the loop taker beak. The first objective may, in one embodiment, be implemented by a wide flat; whereas the second objective may be implemented by a narrow flat or, in the alternative, by a shank of circular cross section having a known spacing in a predetermined plane with respect to the eye of the sewing needle.

DESCRIPTION OF THE DRAWINGS

The invention will be described in greater detail in connection with the drawings in which:

Referring now to FIG. 1 there is shown the head end 10 of a sewing machine from which a needle bar 12 extends to terminate in a needle clamp 13 affixed to the end thereof by screw 14. A sewing needle 16 is shown affixed to the needle clamp 13 in the usual fashion by thumb screw 18 which terminates in a cone point 19 bearing against the shank 20 of the sewing needle. The shank 20 of the sewing needle 16 merges into a tapered section 22, which itself merges into a blade portion 24 that terminates in a point 25 immediately below a thread carrying eyelet 26. The blade 24 is fashioned with a long groove 28 in which the sewing thread may lie to protect it against frictional drag with a work material through which the sewing needle may extend. A loop taker 30 is shown having a loop taker beak 31 which is arranged to pass immediately adjacent the sewing needle 16 on that side of the blade 24 opposite the long groove 28. As is well known in the sewing machine art, this side of the blade 24 is formed with a short groove or with a clearance which does not provide any protection for the sewing thread from drag by the work material and, therefore, elevation of the sewing needle 16 through a work material will cause a drag on the thread so that a loop is thrown behind the sewing needle shown in FIG. 1, which loop is entered by the beak 31 of the loop taker 30 to implement a stitching function.

FIG. 2 shows the configuration of an axially oriented needle channel 34 in the needle clamp 13, which configuration is somewhat typical for needle clamps having the so called one-way insertion feature to insure that the long groove is on the opposite side of the blade from the loop taker beak 31. The channel 34 has a straight side 35 at a standard angle of about 4° 20′ with respect to the longitudinal direction of the lug 37 of the needle clamp 13. It also has a second flat side 36 at an angle of 60° with respect to the side 35. At the intersection of those two sides, and in order to keep from having too sharp an intersection, there is a third flat surface 38 perpendicular to the side 35. Side 39 parallel to side 35 extends with that side to the outside diameter of the needle bar 12.

Figure 1:
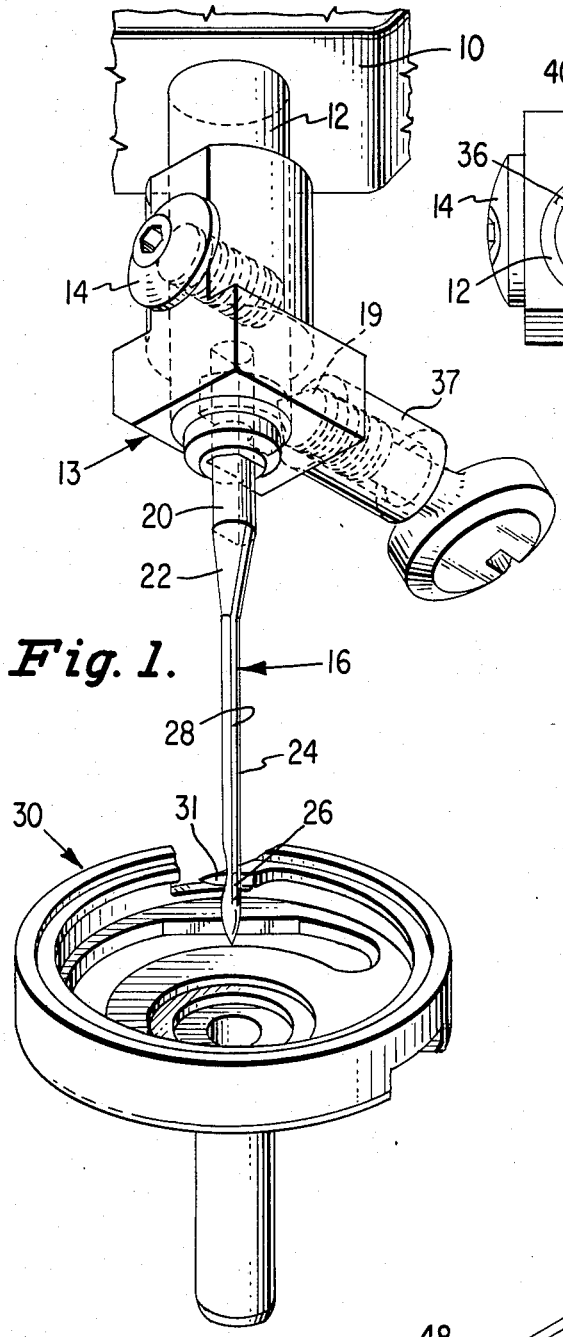
FIG. 1 is a perspective view of a needle clamp and needle assembled on the end of a needle bar of a sewing machine and showing the relationship of a loop taker with the sewing needle.

The needle bar 12 is further formed with a flat bottomed transverse (diametral) groove (not shown) adjacent the needle carrying end of the bar, which groove receives a semi-circular gib 40 (see also FIGS. 7 and 10) having an outer circular surface substantially even with the circular periphery of the needle bar when the gib is spaced from the flat bottom of the transverse groove (not shown) in the needle bar. The gib 40 is fashioned with a circular cutout having the same axis as the outer circular surface and dimensioned to fit closely about the needle shank 20 when the gib is trapped in the transverse groove (not shown) by the affixing to the needle bar 12 of the needle clamp 13 by screw 14. The gib 40 is of sufficient width that the cone point 19 of the thumb screw 18 may bear against the gib to press against and firmly grasp the shank 20 of the needle 16.

Figure 2:
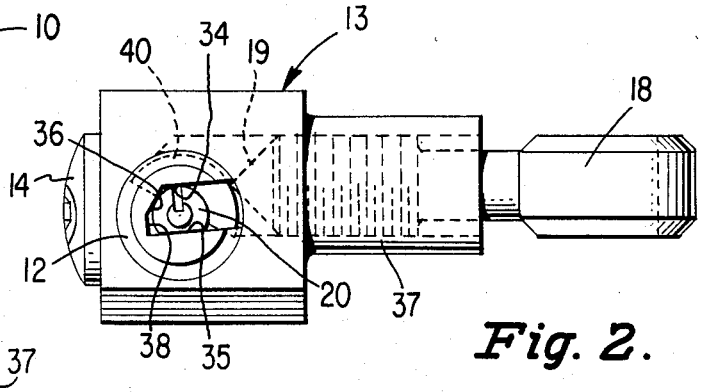
FIG. 2 is an end view of the needle clamp shown in FIG. 1.
Figure 3:
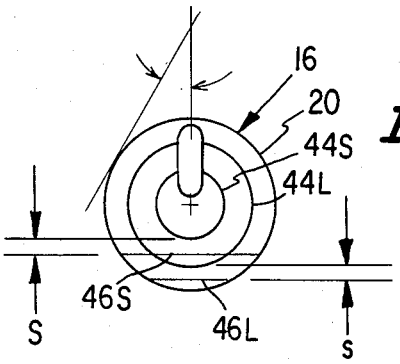
FIG. 3 is a simplified end view representing two needle sizes and illustrating certain dimensions common to the needles.

In FIG. 3 are shown certain geometrical relationships of two needle sizes representative of the largest and smallest standard needles to be used with the clamp 13 in FIG. 2. FIG. 3 represents an end view of the needle 16 looking directly at the point 25. The outermost circle represents the shank 20 which has the same diameter for all needle sizes to be used with the clamp. It is an industry standard that the diameter of the shank 20 is normally 2.060 mm. The second largest circle represents the blade 44L of a number 18 needle and has a diameter of 1.1 mm. The inner circle represents the diameter of a blade 44S of the smallest standard needle, which is a number 9 needle, and has a blade diameter of 0.70 mm.

As is shown in FIG. 3, the distances between a flat plane surface formed on the shank 20 and a plane tangent to the nearest part of the blade 24 remains a constant, S. The flat surface on the shank 20 is indicated by reference numeral 46L for the large needle and 46S for the small needle. The reason for maintaining the distance S constant for needles of any size is to place the part of the blade 24 adjacent the eyelet 26 at a certain distance from the loop taker beak 31 so that the loop taker will always pick up a loop at the same location, no matter what size the needle may be. As a result, the cross sectional area of the shank 20 of a number 9 needle that has a blade 44S of a small diameter is substantially smaller than the cross sectional area of the shank of a number 18 needle that has a blade 44L of a larger diameter, even though the radius of the round part of the shank of both needles is the same. The difference in cross sectional area is produced by the fact that the flat surface 46S in the number 9 needle shank 20 comes closer to the axis than does the flat surface 46L in the shank 20 of the larger needle.

The relationship shown in FIG. 3, represents a common construction for sewing needles. However, it should be pointed out that the U.S. Pat. No. 4,128,067 discloses another relationship in which the distance S is maintained by shifting the axis of the blade portion of the sewing needle in order to maintain this relationship. Thus, for example, the largest needle may have the blade axis coincident with the shank axis; whereas with the smallest needle, the blade axis may be offset sufficiently to maintain the same distance S between the flat on the shank and the blade. This construction is most readily implemented by flow pressing. The teachings of the U.S. Pat. No. 4,128,067 are hereby incorporated by reference herein and made a part of this application.

Returning to FIG. 3, the resulting difference in the cross sectional dimension of the shank 20 of the needles of different blade size makes it necessary to shape the cross section of the needle channel 34 in FIG. 2 carefully so that it will accept the shank 20 of a large needle but will not be so large as to permit the shank of the small needle to be inserted with the flat surface 46S of the small needle facing away from the flat surface 35 of the needle channel.

Figure 4:
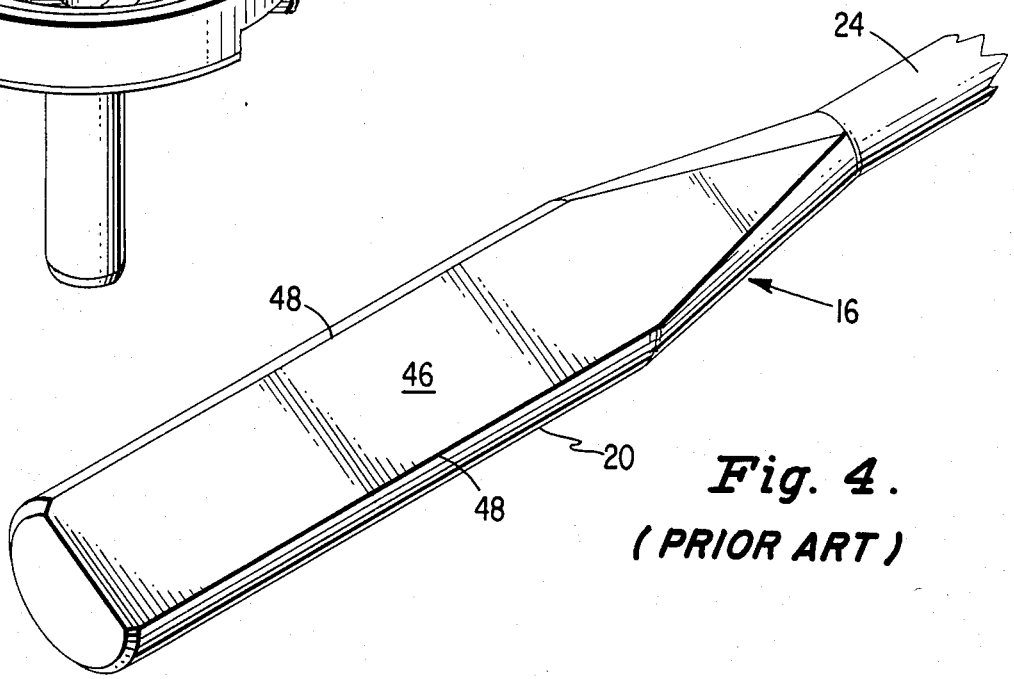
Fig. 4. (PRIOR ART)
FIG. 4 is an elevational view of a shank of a prior art needle to show the ground flat surface thereof.

In FIG. 4 is shown a prior art sewing needle in which the flat surface 46 is produced by grinding a perfectly shaped circular cylinder. It is apparent that this procedure provides a well defined flat surface 46 having sharply defined corners 48. However, formation of sewing needles by flow pressing operations is a presently preferred technique. In a flow pressing operation, material is shifted to form the required needle cross section, and no material removal is required since the original volume of material remains. One consequence of a flow pressing operation however is that the precise circular form previously obtained is not possible in a flow pressing operation. Accordingly, these corners in a flow pressed needle are usually rounded and not sharply defined. The result is that, with the dimensional tolerances on the needle clamp, it may be possible for a flow press needle with rounded corners to be improperly inserted in the needle clamp 13.

Figure 5:
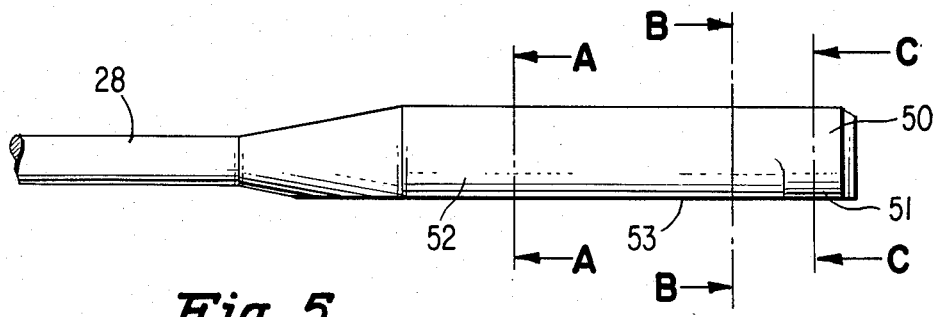
FIG. 5 is a plan view of the shank of the needle bar of the invention.

From the above discussion it is apparent that the flat 46 on the sewing needle 16 performs two functions when used with a one-way needle insertion needle clamp 13. Firstly, the flat 46 provides for the proper orientation of the sewing needle 16 so that the long groove 28 is located away from the loop taking beak 31 of the loop taker 30. Secondly, the flat 46 positions the blade 24 of the sewing needle 16 close enough to the loop taking beak 31 of the loop taker 30 that the loop taking beak will enter a loop of thread thrown behind the sewing needle as it rises through a work material. It is proposed to provide a sewing needle 16 having a shank 20 in two portions including a minor portion 50 adjacent the free extremity of the shank fully formed with an enlarged flat and well defined corners 48 (see FIG. 5). The remaining major portion 52 of the shank 20 may be formed identically to heretofore known flow pressed sewing needles, and is that portion of the shank 20 which the gib 40 bears against to retain the sewing needle 16 affixed to the needle bar 12.

Figure 6A:
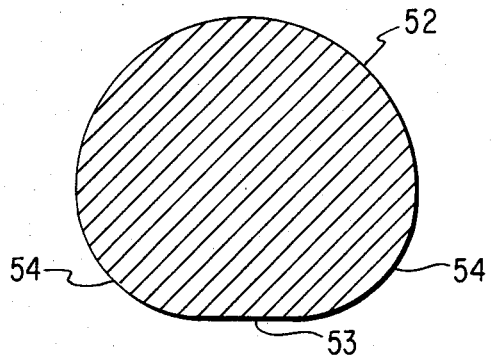
FIGS. 6A, B and C, are cross sections taken substantially along the lines AA, BB and CC of FIG. 5 to show the various cross sections of the shank.
Figure 6B:
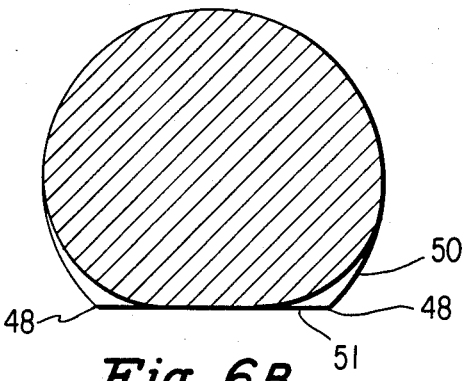
Figure 6C:
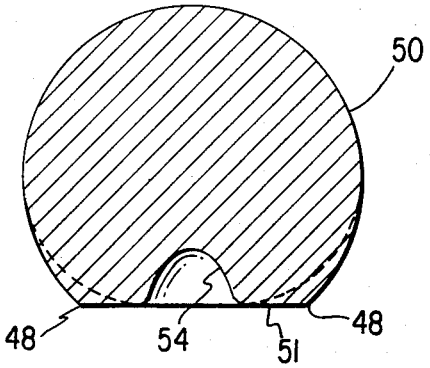

Referring to FIG. 6A there is shown a cross section of the major portion 52 of the shank 20 in which the corners 54 are rounded in the flow pressing operation to maintain the longevity of the dies. A narrow flat surface 53 remains. In FIG. 6B, a cross section is taken again through the major portion 52 of the shank 20, however looking toward the free extremity of the shank. It is apparent that a wider flat surface 51 is provided in the minor portion 50 by protrusions which overhang the major portion 52, which wider flat serves to prevent the insertion of the sewing needle in the needle clamp 13 the wrong way presenting the long groove 28 towards the loop taker beak 31. Referring to FIG. 6C, there is shown a cross section through the minor portion 50 of the cross section 20 looking towards the blade 28, to disclose a cavity 54 from which the extra material may be obtained to provide a symmetrical irregular shape having the wider flat surface 51 and sharp corners 48.

By the above arrangement utilizing a minor portion 50 and major portion 52 of a shank 20, a wider flat surface 51 may be obtained which may be used to properly orient the blade 24 of the sewing needle 16 in the needle clamp 13. Material for the wider flat surface 51 and sharp corners 48 for short length of minor portion 50 may be obtained by displacing material from the cavity 54 extending centrally through a portion of the wider flat surface 51. The remaining flat surface 53 for the major portion 52 may be narrow or may be infinitesimal or non-existent since the primary objective for the major portion in this area is to space the needle blade 24 from the loop taking beak 31, which does not require a flat surface.

Figure 7:
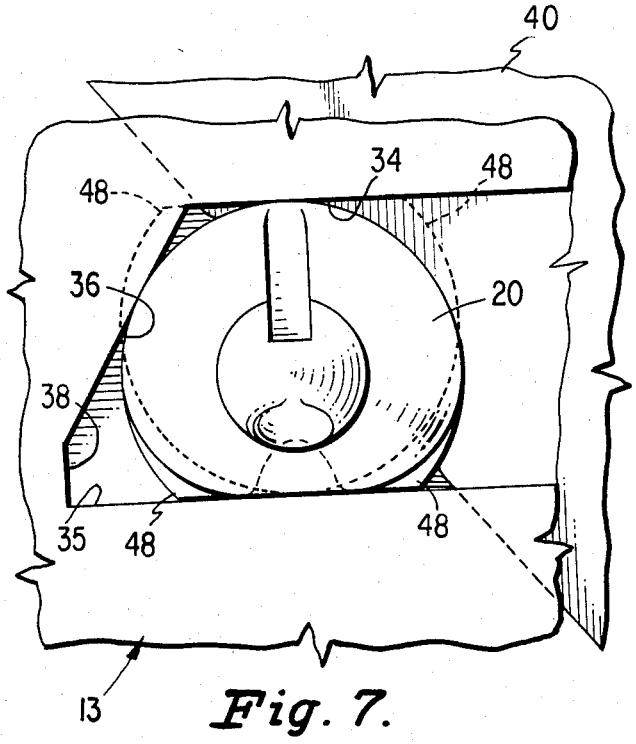
FIG. 7 is an enlargement of a portion of FIG. 2 to show the admission of the cross section of FIG. 6C in the aperture provided therefor, and, in phantom, the inadmissibility of this cross section rotated 180° in this same aperture.

In FIG. 7, there is shown the shank 20 of the sewing needle 16 inserted in the needle clamp 13 in the proper orientation. Shown in phantom is the shank 20 inserted 180° from the proper rotation to demonstrate that the minor portion 50 of the shank will not permit this wrong insertion.

Figure 8:
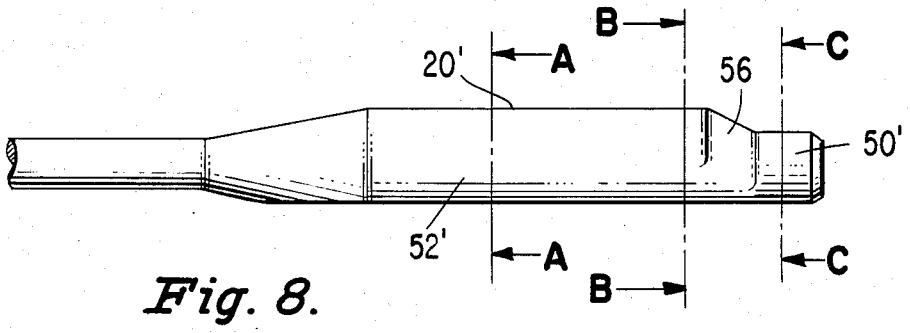
FIG. 8 discloses a plan of a shank of a second embodiment of the invention.

Referring now to FIG. 8, there is shown a preferred embodiment of the modified shank sewing needle 16, having in this case a shank 20′ with a minor portion 50′ and a major portion 52′. A transition zone 56 is provided between the major portion 52′ and minor portion 50′ to accommodate the change in level.

Figure 9A:
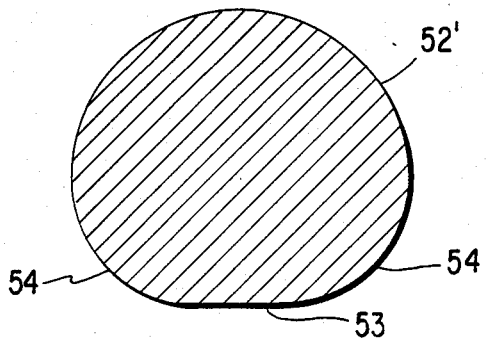
FIGS. 9A, B and C disclose cross sections of the needle shank shown in FIG. 8, taken substantially along the lines AA, BB and CC of FIG. 8; and, FIG. 10 is a view similar to FIG. 7 disclosing the entrance of the cross section of FIG. 9C into the aperture of the needle clamp, and, in phantom, the inadmissibility of this cross section rotated 180° into this same aperture.
Figure 9B:
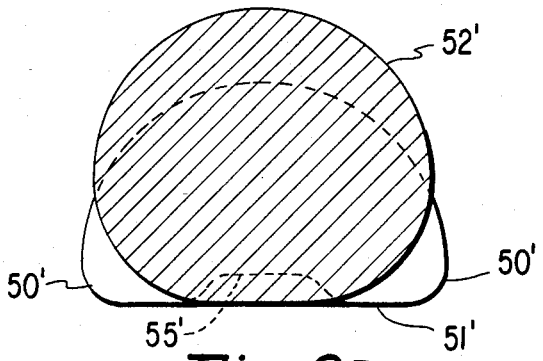
Figure 9C:
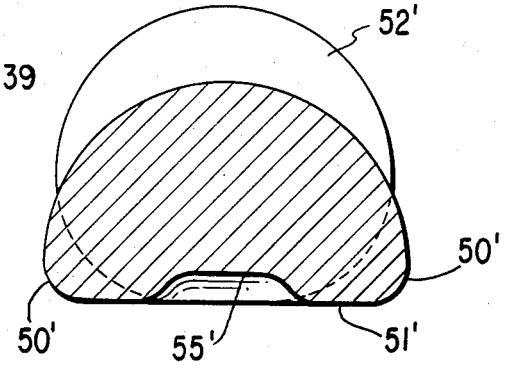

FIG. 9A shows that the major portion 52′ is substantially similar to the major portion 52 shown in FIG. 6A with a narrow remaining flat surface 53 and rounded corners 54. In FIG. 9B, taken through the major portion 52′ looking toward the minor portion 50′, the minor portion 50′ is shown to exhibit a different cross section due to enlarged protrusions extending beyond both sides of the major portion 52′, while the cross section is not quite as high as the major portion. The height of the minor portion 50′ is designed to be sufficient to prevent insertion in the needle clamp 13 in an improper orientation. The minor portion 50′ exhibits the lengthened flat 51′ which approaches the diameter of the major portion in length. The entire minor portion 50′ of the shank 20′ is situated beyond the gib 40 when the shank 20′ is fully inserted into the needle bar 12, and gib 40 bears only against the major portion 52′ when clamping the shank to the needle bar 12. In FIG. 9C, a cross section taken through the middle of the minor portion 50′ a cavity 55′ is visible which provides further material for the lengthened flat 51′.

Figure 10:
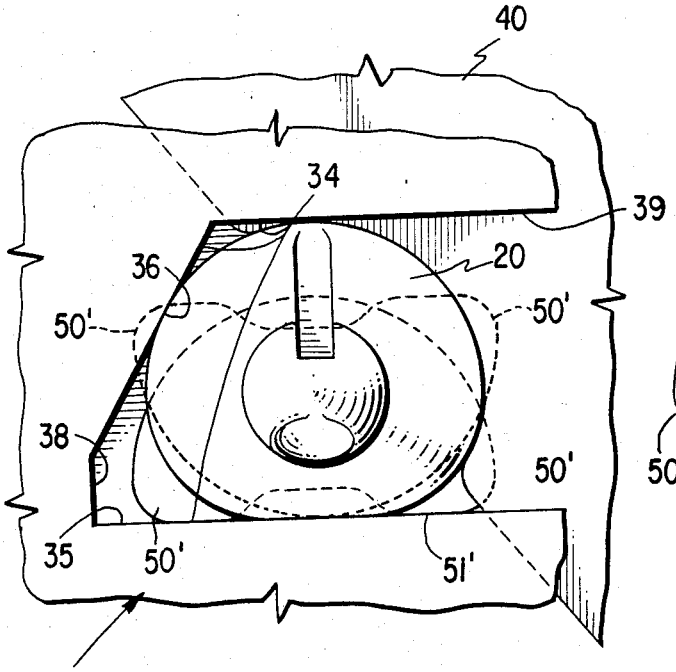

Referring to FIG. 10, the insertion of the shank 20′ in the needle clamp 13 is shown in the proper orientation to indicate the proper fit thereof. The needle shank 20′ is also shown in phantom in the reverse position to indicate the impossibility of insertion in this fashion.

Thus the separation of the needle shank 20 into two portions including a minor portion for controlling the entry orientation of the sewing needle into the needle clamp, and a major portion for controlling the relationship between the blade of the needle and the loop taking beak, is disclosed. Such an arrangement provides that the entire shank need not be made identically to a high degree of accuracy. Accordingly, the major portion of the shank may be fashioned with a shortened flat having well rounded corners blending with the shank, or indeed may be made without a flat at all. The minor portion of the shank 20 location on the free extremity thereof may be relatively short and, therefore, relatively easy to fashion with a high degree of accuracy to insure the proper insertion into the needle clamp 13. In this fashion, a more economical sewing needle may be constructed which will have an enhanced ability to provide the proper insertion.

We claim:

1. A needle for use with a sewing machine having a one way needle clamp of the type having a needle shank accommodating recess with a mouth shaped to admit a given irregular shaped needle shank in only one orientation, and means within said recess for locating a reference surface on said needle shank in a predetermined plane with respect to said sewing machine, said needle having a blade extending parallel to the lengthwise axis of said needle, an enlarged shank including a minor portion adjacent the free extremity thereof and a major portion extending from the blade and formed with a flat planar reference surface for cooperation with said locating means in said needle clamp, only said minor portion being formed with with said given irregular shape for cooperation with said needle clamp mouth to admit said needle into said needle clamp recess in only one orientation, in which said flat planar reference surface along said major portion of said shank extends into said given irregular shape in said minor portion at the free extremity of said shank, and said given irregular shape further includes protrusions formed at each side of said flat, said protrusions substantially extending the width of said flat in said minor portion as compared with the width of said flat along said major shank portion.

2. A needle as set forth in claim 1 in which the major portion of said shank is generally cylindrical in form and in which said flat in said minor portion is extended by said protrusions to a width at least three quarters of the diameter of said cylindrical shank.

3. A needle as set forth in claim 2 in which said minor portion is of a reduced height so as to provide additional material for said protrusions thereby to extend the width of said flat in said minor portion of substantially the width of said diameter of said generally cylindrical shank.

4. A needle as set forth in claim 3 in which the height of said minor portion is sufficient when taken with the width of said flat, to permit insertion of said minor portion into said needle clamp in said only one orientation, but to prevent insertion of said minor portion into said needle clamp in any other orientation.

5. A needle as set forth in claims 2 or 3 in which said flat in said minor portion may be formed with a substantially centrally situated cavity to provide additional material for said protrusions.

* * * * *